US009180380B2

(12) United States Patent
Cannon

(10) Patent No.: US 9,180,380 B2
(45) Date of Patent: Nov. 10, 2015

(54) TOY FIGURINE WITH INTERNAL LIGHTING EFFECT

(75) Inventor: Bruce Cannon, El Segundo, CA (US)

(73) Assignee: Mattel, Inc., El Segundo, CA (US)

( * ) Notice: Subject to any disclaimer, the term of this patent is extended or adjusted under 35 U.S.C. 154(b) by 524 days.

(21) Appl. No.: 13/565,092

(22) Filed: Aug. 2, 2012

(65) Prior Publication Data

US 2013/0196569 A1 Aug. 1, 2013

Related U.S. Application Data

(60) Provisional application No. 61/515,517, filed on Aug. 5, 2011.

(51) Int. Cl.

| | |
|---|---|
| ***A63H 33/22*** | (2006.01) |
| ***A63H 3/00*** | (2006.01) |
| ***A63H 9/00*** | (2006.01) |

(52) U.S. Cl.

CPC ..... *A63H 3/006* (2013.01); *A63H 9/00* (2013.01); *Y10T 29/49002* (2015.01)

(58) Field of Classification Search

None

See application file for complete search history.

(56) References Cited

U.S. PATENT DOCUMENTS

| | | | | |
|---|---|---|---|---|
| 3,973,840 | A | | 8/1976 | Jacobs et al. |
| 4,456,384 | A | | 6/1984 | Murakami |
| 4,642,710 | A | | 2/1987 | Murtha et al. |
| 4,654,659 | A | | 3/1987 | Kubo |
| 4,729,564 | A | | 3/1988 | Kuna et al. |
| 4,737,131 | A | | 4/1988 | Sirota |
| 4,740,186 | A | | 4/1988 | Sirota |
| 4,802,879 | A | * | 2/1989 | Rissman et al. ..... 446/175 |
| 4,813,907 | A | | 3/1989 | Rissman et al. |
| 4,878,873 | A | * | 11/1989 | Yamaguchi et al. ..... 446/321 |
| 5,738,526 | A | | 4/1998 | Cerda et al. |
| 5,971,827 | A | * | 10/1999 | Lee et al. ..... 446/81 |
| 6,048,209 | A | | 4/2000 | Bailey |
| 6,089,951 | A | | 7/2000 | Ostendorff |
| 6,159,101 | A | * | 12/2000 | Simpson ..... 463/46 |
| 6,160,540 | A | | 12/2000 | Fishkin et al. |
| 6,227,966 | B1 | | 5/2001 | Yokoi |
| 6,264,521 | B1 | * | 7/2001 | Hernandez ..... 446/73 |
| 6,467,908 | B1 | | 10/2002 | Mines et al. |
| 6,554,679 | B1 | | 4/2003 | Shackelford et al. |
| 6,558,225 | B1 | * | 5/2003 | Rehkemper et al. ..... 446/484 |
| 6,576,013 | B1 | * | 6/2003 | Budman et al. ..... 623/6.64 |
| 6,697,602 | B1 | | 2/2004 | Ferrigno et al. |
| 6,699,097 | B2 | | 3/2004 | Rudell et al. |
| 6,773,344 | B1 | | 8/2004 | Gabai et al. |
| 6,800,013 | B2 | | 10/2004 | Liu |
| 6,835,131 | B1 | | 12/2004 | White et al. |
| 6,959,166 | B1 | | 10/2005 | Gabai et al. |
| 7,131,887 | B2 | | 11/2006 | Hornsby et al. |
| 7,370,974 | B2 | | 5/2008 | Yamada et al. |
| 7,431,630 | B2 | | 10/2008 | Dubois et al. |
| 7,442,107 | B1 | | 10/2008 | Ueda et al. |
| 7,551,523 | B2 | | 6/2009 | Larian |
| 7,607,962 | B2 | | 10/2009 | Hardin |
| 7,806,407 | B2 | | 10/2010 | Ozaki et al. |
| 2003/0096556 | A1 | * | 5/2003 | Fong ..... 446/330 |

(Continued)

*Primary Examiner* — Tramar Harper

(74) *Attorney, Agent, or Firm* — Edell, Shapiro & Finnan, LLC

(57) ABSTRACT

A toy figurine includes an internal lighting effect. The internal lighting is visible through the outer surface of the figurine and may be manipulated to produce various lighting effects. The internal lighting includes a lighting layer, a visual effects display layer and a diffusion layer. The light diffusion layer may include an external surface of the toy figurine.

19 Claims, 4 Drawing Sheets

(56) References Cited

U.S. PATENT DOCUMENTS

| | | | | |
|---|---|---|---|---|
| 2008/0139265 | A1 | 6/2008 | Hardin et al. | |
| 2008/0176481 | A1 | 7/2008 | Zebersky | |
| 2008/0287033 | A1 | 11/2008 | Steinberg | |
| 2008/0303698 | A1 | 12/2008 | Casparian et al. | |
| 2008/0311977 | A1 | 12/2008 | Okada | |
| 2009/0137185 | A1* | 5/2009 | Zheng | 446/268 |
| 2009/0149106 | A1 | 6/2009 | D'Alleva et al. | |
| 2010/0144432 | A1 | 6/2010 | Nittou | |
| 2010/0184510 | A1 | 7/2010 | Nittou | |
| 2010/0248813 | A1 | 9/2010 | DePalma | |
| 2012/0142249 | A1* | 6/2012 | Chan et al. | 446/321 |

* cited by examiner

TOY FIGURINE WITH INTERNAL LIGHTING EFFECT

CROSS-REFERENCE TO RELATED APPLICATION

This application claims priority to and is based on U.S. Patent Application No. 61/515,517, filed Aug. 5, 2011, entitled "Toy Figurine With Internal Lighting Effect," the entire disclosure of which is incorporated by reference herein in its entirety.

FIELD OF THE INVENTION

The disclosure relates generally to a toy figurine. More specifically, the toy figurine includes internal lighting that is visible through the outer surface of the figurine.

BACKGROUND

Toy figurines have been and continue to be a stable source of amusement for children. Enhancements and features that spark a child's imagination and provide continued engagement of the toy figurine with the child add to its play value and build a bond between the child and the toy figurine.

U.S. Pat. No. 6,159,101 to Simpson ("Simpson") discloses interactive toy products including a controller and a casing in the form of a figurine having one or more articulated limbs. Sensors detect movement of the limbs and use the detection as input to the controller to control a game playing activity. A screen, such as a liquid crystal display (LCD) screen, is set in the torso of the figurine. The screen displays a representation of the toy figurine, and movement of the articulated limbs of the figurine generates a corresponding movement of the displayed figurine. The screen may be provided with a cover, which may be configured as a piece of clothing, armor, or other equipment carried by the figurine, such as a breast plate. The breast plate provides protection for the screen. Here, only when the cover is removed from the figurine is the LCD screen visible to the child, so that the child may play the game on the screen. Because the screen is exposed, the Simpson product lacks the sense of "magic" and wonder from any lighting effects.

SUMMARY

The present invention is directed towards a toy figurine including internal lighting, such as a light producing device, that is visible through a light diffusion layer. The light producing device may include a lighting layer and a visual effects display layer. The light diffusion layer may include an external surface of the toy figurine.

In one embodiment, a toy with a toy housing includes a lighting layer inside the toy housing. The lighting layer includes a light emitting surface, a visual effects display layer inside the toy housing, and at least one light diffusion layer proximate to the light emitting side of the visual effects display layer. The visual effects display layer includes a light reception side and a light emitting side, the light reception side being adjacent the light emitting surface of the lighting layer.

In other embodiments, the lighting layer comprises a backlight panel or a reflective light box. Similarly, in some embodiments, the visual effects display layer comprises a liquid crystal display. In some of these embodiments, the liquid crystal display comprises a negative-mode liquid crystal display. In still other embodiments, the at least one light diffusion layer comprises an external layer of a toy figurine torso. In some embodiments, the at least one light diffusion layer encapsulates the lighting layer and the visual effects display layer.

In yet another embodiment, the toy also includes a controller inside the toy housing operably connected to the lighting layer and the visual effects display layer. The controller can be configured to cause the lighting layer to selectively transmit light through the visual effects display layer and the at least one light diffusion layer. In some of these embodiments, the visual effects display layer comprises a group of pixels. When the visual display layer comprises a group of pixels, the controller can be further configured to cause the visual effects display layer to selectively activate one or more of the pixels in some embodiments or further configured to cause pulse-width modulation of selected pixels on the visual effects display layer in other embodiments. In yet other embodiments, the controller comprises a printed circuit board.

According to at least one embodiment, a method of creating a lighting effect in a toy includes the steps of: providing a lighting layer including a light emitting surface; providing a visual effects display layer including a light reception side and a light emitting side, the light reception side being adjacent the light emitting surface of the lighting layer; providing a light diffusion layer proximate to the light emitting side of the visual effects display layer; and providing a controller configured to cause the lighting layer and the visual effects display layer to selectively transmit light through the light diffusion layer.

In some embodiments, the step of providing a controller comprises providing a controller operable to activate the lighting layer to transmit light to the visual effects display layer. In other embodiments, the step of providing a controller further comprises providing a controller configured to coordinate the selective activation and selective pulse-width modulation within each group of pixels across the visual effects display layer.

According to yet another embodiment, a toy figurine includes a torso, including an outer layer and an inner cavity, and a light producing device disposed with the inner cavity. The outer layer comprises a light diffusion layer in communication with the inner cavity and the light producing device includes a lighting assembly including a light emitting surface and a visual effects display layer including a light reception side and a light emitting side. The light reception side is configured to receive light from the lighting assembly and the light emitting side is configured to direct light towards the outer layer of the torso. In some embodiments, the toy figurine also includes a controller configured to operate the light producing device.

Other systems, methods, features and advantages will be, or will become, apparent to one with skill in the art upon examination of the following figures and detailed description. All such additional systems, methods, features and advantages are included within this description, are within the scope of the claimed subject matter, and are protected by the following claims.

BRIEF DESCRIPTION OF THE DRAWINGS

The toy figurine with internal lighting effect may be better understood with reference to the following drawings and description. The elements in the figures are not necessarily to scale, emphasis instead being placed upon illustrating the principles of the toy figurine with internal lighting effect. In the figures, like-referenced numerals designate corresponding parts throughout the different views.

DETAILED DESCRIPTION

The toy figurine includes internal lighting that is visible through a light diffusion layer. The internal lighting may include a lighting layer, such as a backlight panel, and a visual effects display layer, such as a liquid crystal display (LCD) screen. The light diffusion layer may include an external surface of the toy figurine. The light diffusion layer may have semi-translucent properties to allow light from the LCD screen to emit from the figurine, yet still be sufficiently opaque to hide the LCD screen and other components inside the figurine. The light diffusion layer may provide a sense of wonder by revealing the internal lights and patterns of the lights without revealing the source of the light.

Figure 1:
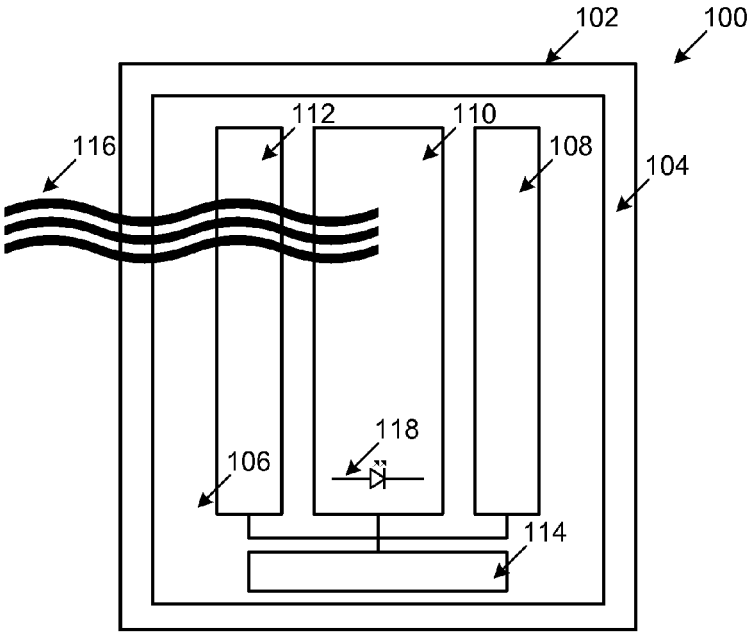
FIG. 1 is a diagram of a toy.

FIG. 1 is a diagram 100 of a toy 102 according to some embodiments of the present invention. The toy 102 includes a light diffusion layer 104 and an interior area 106. The interior area 106 includes a controller 108, a lighting layer 110, a visual effects display layer 112 and a power source 114. The controller 108, lighting layer 110 and visual effects display layer 112 are electrically connected to and draw power from the power source 114. The controller 108 is operably connected to the lighting layer 110 and the visual effects display layer 112. The controller may be operable to direct the lighting layer 110 to selectively transmit light 116 through the visual effects display layer 112 and the light diffusion layer 104. The lighting layer 110 includes one or more light sources 118. The controller may also be operable to direct the visual effects display layer 112 to selectively block or transmit portions of the light 116. The selective blocking or transmission creates a lighting effect within the toy 102. The transmitted portions of the light 116 pass through and are softened by the light diffusion layer 104.

Figure 2:
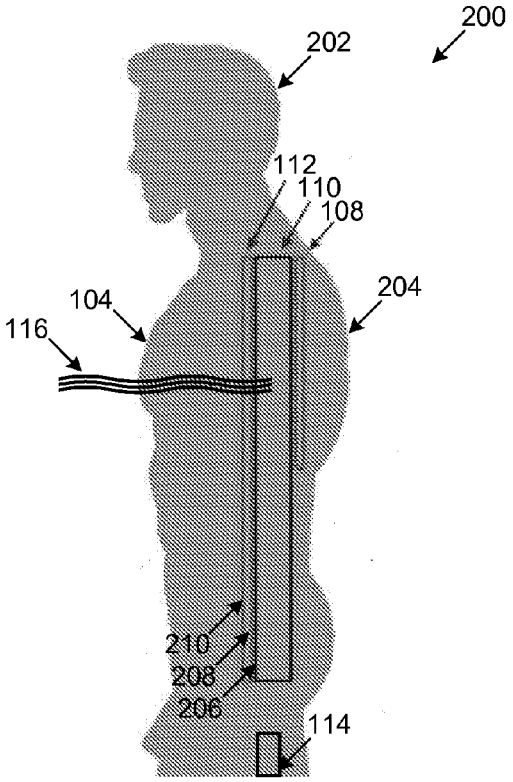
FIG. 2 is an illustration of a toy figurine.

FIG. 2 is an illustration 200 of a toy figurine 202 according to some embodiments of the present invention. The toy figurine 202 includes a toy figurine torso 204. The toy figurine torso 204 includes a light diffusion layer 104. In the illustrated embodiment, the light diffusion layer 104 is an external layer of the toy figurine torso 204, such as a toy housing. The light diffusion layer 104 may be composed of a plastic, such as polyvinyl chloride (PVC) or acrylonitrile butadiene styrene (ABS), and may be tinted or colored. The light diffusion layer 104 may be semi-translucent to allow some light 116 from inside the toy figurine torso 204 to be visible from outside the torso through the light diffusion layer 104. The light diffusion layer 104 may be sufficiently opaque to allow any components internal to the toy figurine torso 204 to remain hidden or obfuscated from direct view. The combination of semi-translucency and opaqueness creates a "magical" illusion of light emerging from the core of the toy figurine 202. The illusion may be enhanced if the light diffusion layer 104 is colored or tinted to match the coloration or design of the remainder of the toy figurine 202.

In some embodiments, the toy figurine 202 represents HAL JORDAN GREEN LANTERN from DC COMICS. The figurine may be in the 10" or 12" scale and have a similar appearance to the GREEN LANTERN GALACTIC SCALE HAL JORDAN figurine (item T7826) available from MATTEL, INC. In contrast to the GALACTIC SCALE figurine, which simply lights up a ring symbol on the figurine's chest when activated, the figurine of the present invention includes more complicated visual lighting effects upon activation. The visual lighting effects may include one or more patterns of light that may appear to move up and down or across the figurine's torso and simulate electricity, plasma or other energy coursing through the figurine's torso, skin or costume.

The toy figurine 202 also includes a controller 108, a lighting layer 110, a visual effects display layer 112 and a power source 114. The controller 108, lighting layer 110 and visual effects display layer 112 are each affixed entirely within the toy figurine torso 204. The controller 108 need not be affixed within the torso, so long as it remain communicably or operably coupled to the lighting layer 110 and the visual effects display layer 112. Similarly, a light source associated with the lighting layer 110 need not be affixed within the torso, so long as the light produced by the light source is adequately directed through the visual effects display layer 112 and the light diffusion layer 104, e.g. via light piping or reflection. The power source 114 may be in a toy figurine appendage, such as the leg, and may be electrically coupled to the controller 108, the lighting layer 110, and the visual effects display layer 112.

The controller 108 may include a printed circuit board (PCB). The PCB may be configured with sufficient logic to direct the lighting layer 110 and the visual effects display layer 112 to create lighting or visual effects. The lighting layer 110 may include one or more light sources, such as one or more light emitting diodes (LEDs). The number of light sources may depend on desired light intensity or brightness output by the final product. For a 12" scale GREEN LANTERN figurine, the lighting layer 110 may include from one to four green LEDs. The lighting layer 110 may further include a backlight plane or a white reflective light box. The plane or box may redirect and spread the light 116 from the light source over a larger surface area, such as a light emitting surface 206. For example, a backlight plane may spread the light 116 from four green LEDs over a light emitting surface area that is of similar size and scale as the input surface area of a light reception side 208 of the visual effects display layer 112. The white reflective light box may include the inside of a toy figurine torso that is coated with a reflective material.

The visual effects display layer 112 may include a LCD screen. In some embodiments, the LCD screen is a negative-mode LCD screen, i.e. an LCD screen with a default dark or black background and white or light foreground components, segments, or pixels (hereinafter "pixels"), when activated. In some further embodiments, the LCD screen is a negative-mode super-twisted nematic (STN) LCD screen. A STN LCD screen may have a sufficiently fast response time for display of visual effects. With a negative-mode LCD screen, the pixels may be used as sequential shutters to block light moving through the LCD screen from a light reception side 208 to a light emitting side 210. The pixels need not form a tight grid, but may be arranged in a custom shape, such as a ring or a matrix of larger dots. The selective activation of the pixels then selectively blocks the passing light 116 and may be controlled to form or create patterns of light or lighting effects. The effects may include glow effect animations or the illusion of moving light. The lighting effects may pass from the light emitting side 210 and through the light diffusion layer 104 to be seen by an observer. The addition of the light diffusion layer 104 may deliver to the observer the impression of smoothly flowing complex animations from the relatively few activated pixels of the LCD screen.

Figure 3:
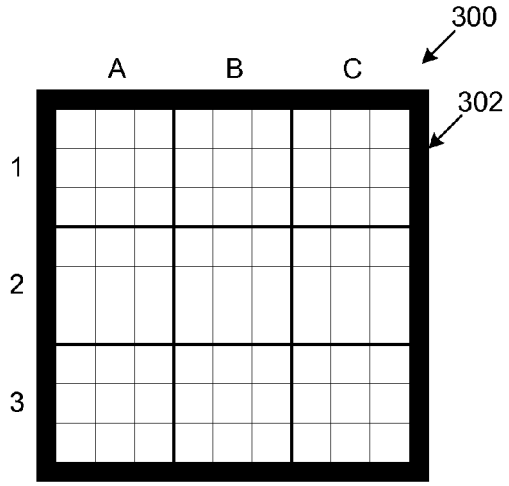
FIG. 3 is a diagram of an illustrative negative-mode LCD screen.

FIG. 3 is a diagram 300 of an illustrative negative-mode LCD screen 302. The illustrative negative-mode LCD screen 302 is shown with all of its pixels fully activated. The pixels are segmented into nine groups (three-by-three) of nine pixels (three-by-three) each. The columns for the groups are labeled with "A", "B" and "C", while the rows are labeled with "1", "2" and "3". In this illustration, the groups may be conceptual, but in other embodiments, groups of pixels may be physically separated from other groups of pixels. The groups of pixels may form customized shapes, such as rings, and/or vary in the number of pixels from group to group. Furthermore, the segmentation need not be limited to division by three or by nine. Segmentation may be accomplished according to the needs and design of the product.

Figure 4:
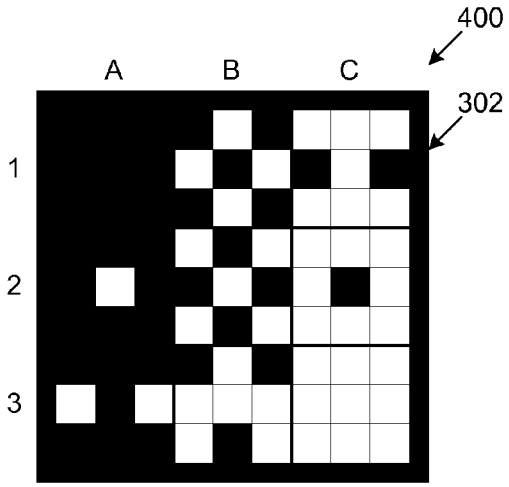
FIG. 4 is a diagram of the illustrative negative-mode LCD screen in a different activation state.

FIG. 4 is a diagram 400 of the illustrative negative-mode LCD screen 302 in a different activation state. The illustrative negative-mode LCD screen 302 is shown with its different groups of pixels each in different activation states. For example, pixel group A1 is fully deactivated, while pixel group C3 is fully activated. Pixel group B2 includes four deactivated pixels and five activated pixels. By selectively controlling the activation of pixels within each pixel group, a digital halftoning effect may be accomplished across the LCD screen. That is, from a distance, an observer's eye may be tricked into thinking there is a range of light intensity across the entire screen, rather than the discrete binary composition of active or inactive pixels. This digital halftoning process may create a visual effect across the LCD screen.

In addition, the activation of each individual pixel or group of pixels may be pulse-width modulated (PWM). The modulation may alter the amount of light passing through the pixel or group of pixels over a certain time period and, therefore, alter a perceived light intensity from that pixel or group of pixels. The PWM may also create a visual effect across the LCD screen. In some embodiments, PWM and digital halftoning may be used together to create additional visual effects.

In alternative embodiments, the lighting layer 110 may include one or more light sources with different colors. For example, the lighting layer 110 may include one red, one blue, and one green LED, or several tri-colored (RGB or Red, Green, Blue) LEDs. The controller 108 may then coordinate the operation of the different-colored light sources with the operation of the visual effects display layer 112 to create visual effects with different colors. In this manner, the lighting effects may include simulated blue lighting flowing up the figurine's torso subsequently followed by simulated green lightning flowing down the figurine's torso.

In yet other alternative embodiments, the controller 108 may synchronize activation of the different-colored light sources with the activation of the pixels in the visual effects display layer 112. The controller 108 may pulse-width modulate activation of the light sources in coordination with the modulation of the pixels. Thus, for example, when the duty cycle for a pixel is controlled such that when a red light source is active, the pixel is controlled to block the light, and when a green and subsequently a blue light source are active, the pixel is controlled to pass the light, the result is an appearance of an orange pixel, if the modulation speed is sufficient to fool the human eye. In this manner, the light from the light sources may be blended such that the lighting effects may be expanded to include colors beyond those of the light sources individually, as well as to include animations.

Figure 5:
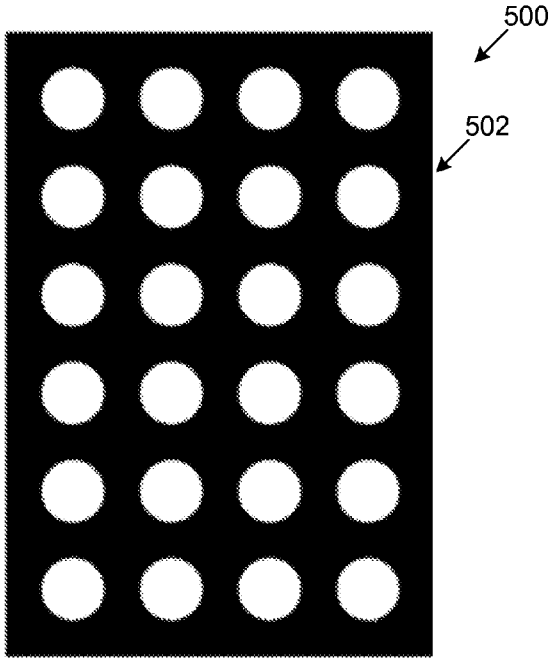
FIG. 5 is a diagram of an alternative negative-mode LCD screen.

FIG. 5 is a diagram 500 of an alternative negative-mode LCD screen 502. The illustrated negative-mode LCD screen 502 is shown with six rows and four columns of circles. Each circle may be a pixel group that may be selectively activated to create a digital halftoning effect or pulse-width modulated to vary a perceived light intensity. The negative-mode LCD screen 502 need not be limited to six rows and four columns, but may be arranged in such a manner as to simulate a LED array. The screen may then be used as a replacement for a LED array with a potential for cost savings in assembly and manufacturing. Further, replacing an LED array with a LCD screen may improve the resolution of the lighting effects.

Figure 6:
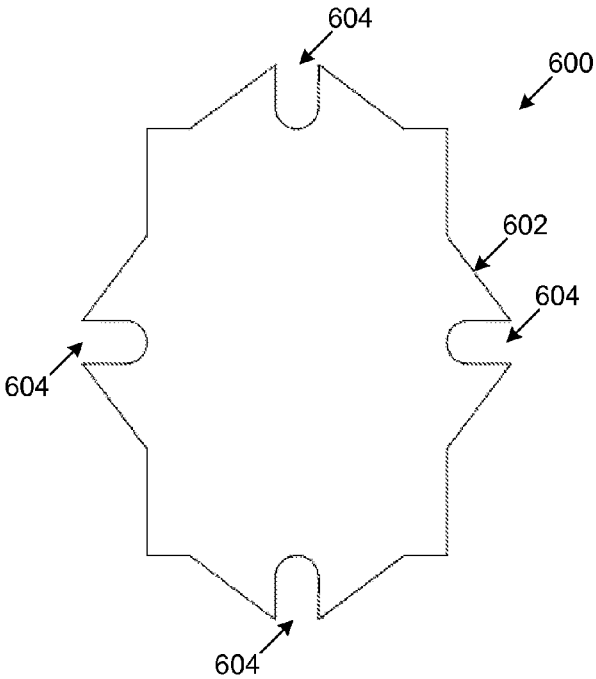
FIG. 6 is an illustration of a backlight plane.

FIG. 6 is an illustration 600 of a backlight plane 602 according to some embodiments of the present invention. The backlight plane 602 may be cast from a clear resin or plastic. One of the surfaces, such as the back surface, may be textured or coated with a light-reflecting material. The backlight plane 602 may include one or more notches, such as the four notches 604 in the illustrated embodiment. Each notch may be configured to receive an LED, where light emitted from the LED enters the backlight plane 602 through the notch surface and exits the backlight plane 602 through a light emitting surface.

Figure 7:
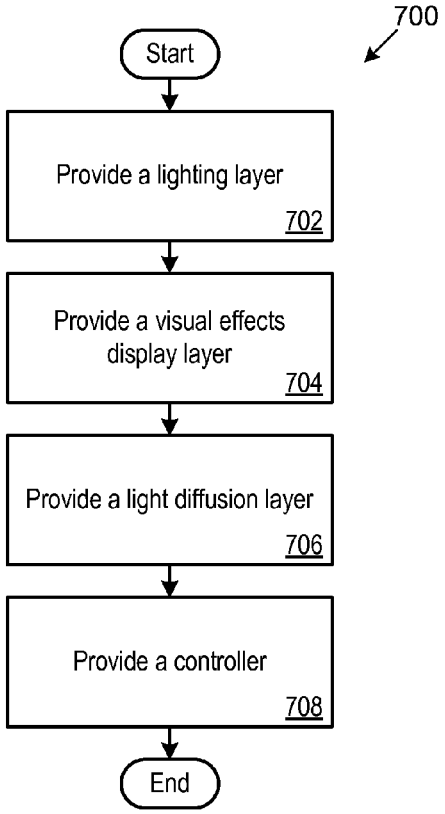
FIG. 7 is a flowchart for creating a lighting effect.

FIG. 7 is a flowchart 700 for creating a lighting effect according to some embodiments of the present invention. A lighting layer is provided (702). The lighting layer may be a backlight plane or a white reflective light box. The lighting layer may include a light emitting surface and one or more LEDs. A visual effects display layer is provided (704). The visual effects display layer may be placed adjacent the lighting layer. More specifically, the visual effects display layer may be placed adjacent a light emitting surface of the lighting layer. In this manner, light from the lighting layer may enter the visual effects display layer. The visual effects display layer may include a light reception side and a light emitting side. The light reception side may receive light from the light emitting surface of the lighting layer. The light emitting side of the visual effects display layer may emit light from the visual effects display layer.

A light diffusion layer is provided (706). The light diffusion layer may be placed proximate to the light emitting side of the visual effects display layer. In this manner, light from the visual effects display layer may enter and pass through the light diffusion layer. The light diffusion layer may diffuse the light passing through it. A controller is provided (708). The controller may be operably connected to the lighting layer and the visual effects display layer. The controller may cause the lighting layer and the visual effects display layer to selectively transmit light through the light diffusion layer.

Figure 8:
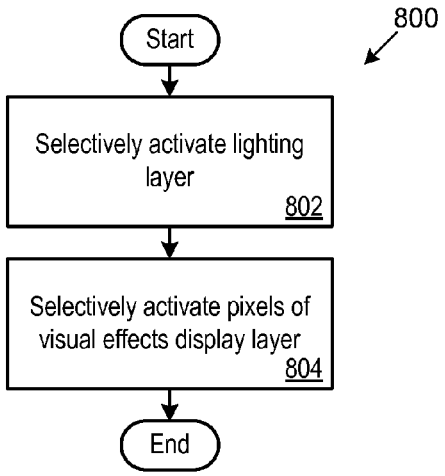
FIG. 8 is a flowchart for directing a lighting layer and a visual effects display layer to selectively transmit light through a light diffusion layer.

FIG. 8 is a flowchart 800 for directing a lighting layer and a visual effects display layer to selectively transmit light through a light diffusion layer according to some embodiments of the present invention. A controller selectively activates a lighting layer (802). The lighting layer may be selectively activated to transmit light to the visual effects display layer. The selective activation may include selectively activating one or more LEDs in the lighting layer. A controller selectively activates one or more pixels of a visual effects display layer (804). The pixels may be activated as one or more groups of pixels. The controller may coordinate the pixel or pixel group to create a halftoning effect and/or may pulse-width modulate the pixel or pixel groups to vary the perceived light intensity of the pixel or group of pixels.

In use, the controller 108 may be configured to cause the internal lighting (including lighting layer 110 and visual effects display layer 112) to produce a lighting effect in response to any desirable actuation or stimulation. For example, in some embodiments, the controller 108 may be configured to cause the internal lighting to produce a lighting effect when a portion of a toy, such as the arm of a toy figurine, is moved into a certain position, such as any position raised above the shoulder. In other embodiments, the toy may include a button, trigger, sensor, or some combination thereof, including, but not limited to, physical triggers, motion sensors, and infrared sensors, that may effectuate the production of a lighting effect when actuated.

It is believed that the disclosure set forth above encompasses multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any description recites "a" or "a first" element or the equivalent thereof, such disclosure should be understood to include incorporation of one or more such elements, neither requiring nor excluding two or more such elements.

While various embodiments of the toy figurine with internal lighting effect have been described, it will be apparent to those of ordinary skill in the art that many more embodiments and implementations are possible within the scope of the invention. Thus, it is intended that the present invention covers modifications and variations of this invention provided they come within the scope of the appended claims and their equivalents.

What is claimed is:

1. A toy with a toy housing comprising:

a lighting layer inside the toy housing, the lighting layer including a light emitting surface;

a visual effects display layer inside the toy housing, the visual effects display layer including a light reception side and a light emitting side, the light reception side being adjacent the light emitting surface of the lighting layer such that light emitted from the light emitting surface enters the visual effects display layer at the light reception side and exits the visual effects display layer at the light emitting side when passing through the visual effects display layer unimpeded; and a torso comprising at least one light diffusion layer proximate to the light emitting side of the visual effects display layer, wherein the at least one light diffusion layer encapsulates the lighting layer and the visual effects display layer.

2. The toy of claim 1, wherein the lighting layer comprises a backlight panel.

3. The toy of claim 1, wherein the lighting layer comprises a reflective light box.

4. The toy of claim 1, wherein the visual effects display layer comprises a liquid crystal display.

5. The toy of claim 4, wherein the liquid crystal display comprises a negative-mode liquid crystal display.

6. The toy of claim 1, wherein the at least one light diffusion layer comprises an external layer of the toy figurine's torso.

7. The toy of claim 1, further comprising:

a controller inside the toy housing operably connected to the lighting layer and the visual effects display layer, the controller being configured to cause the lighting layer to selectively transmit light through the visual effects display layer and the at least one light diffusion layer.

8. The toy of claim 7, wherein the visual effects display layer comprises a group of pixels and the controller is further configured to cause the visual effects display layer to selectively activate one or more of the pixels, wherein activated pixels block light from passing through the visual effects display layer.

9. The toy of claim 7, wherein the visual effects display layer comprises a group of pixels and the controller is further configured to cause pulse-width modulation of selected pixels on the visual effects display layer, wherein modulated pixels alter the amount of light from passing through the visual effects display layer.

10. The toy of claim 7, wherein the controller comprises a printed circuit board.

11. A method of creating a lighting effect in a toy, the method comprising:

providing a lighting layer including a light emitting surface;

providing a visual effects display layer including a light reception side and a light emitting side, the light reception side being adjacent the light emitting surface of the lighting layer such that the visual effects display layer is configured to receive light emitted from the light emitting surface at the light reception side, configured to allow light to pass between the light reception side and light emitting side, and configured to allow light to exit the visual effects display layer at the light emitting side;

providing a torso comprising a light diffusion layer proximate to the light emitting side of the visual effects display layer, wherein the at least one light diffusion layer encapsulates the lighting layer and the visual effects display layer; and providing a controller configured to cause the lighting layer and the visual effects display layer to selectively transmit light through the light diffusion layer.

12. The method of claim 11, wherein the controller is further configured to activate the lighting layer to transmit light to the visual effects display layer.

13. The method of claim 11, wherein the visual effects display layer comprises a group of pixels and the controller is further configured to selectively activate one or more pixels within the group of pixels on the visual effects display layer, wherein activated pixels block light moving through the visual effects display layer from the light reception side to the light emitting side.

14. The method of claim 13, wherein the controller is further configured to selectively pulse-width modulate the activated pixels on the visual effects display layer, wherein modulated activated pixels selectively alter the amount of portion of light blocked from passing through the visual effects display layer from the light reception side to the light emitting side.

15. The method of claim 14, wherein the controller is further configured to coordinate the selective activation and selective pulse-width modulation within each group of pixels across the visual effects display layer.

16. A toy figurine comprising:

a torso, wherein the torso comprises an outer layer and an inner cavity, the outer layer comprising a light diffusion layer in communication with the inner cavity; and a light producing device disposed within the inner cavity and comprising:

a lighting assembly including a light emitting surface; and a visual effects display layer including a light reception side, a light emitting side, and a group of pixels, the light reception side being configured to receive light from the lighting assembly, the light emitting side configured to direct light towards the outer layer of the torso, and one or more pixels within the group of pixels are configured to be activated, wherein activated pixels block at least a portion of the light received at the light reception side from exiting the visual effects display layer at the light emitting side.

17. The toy figurine of claim 16, further comprising:

a controller, wherein the controller is configured to operate the light producing device.

18. The toy figurine of claim 17, wherein the controller is further configured to selectively activate one or more pixels within the group of pixels on the visual effects display layer.

19. The toy figurine of claim 17, wherein the controller is further configured to selectively pulse-width modulate the activated pixels on the visual effects display layer.

* * * * *